US010217355B1

(12) United States Patent
Snyder

(10) Patent No.: US 10,217,355 B1
(45) Date of Patent: Feb. 26, 2019

(54) SYSTEM FOR THE AUTOMATIC DEPLOYMENT OF TRAFFIC CONTROL SIGNS DURING A POWER OUTAGE

(71) Applicant: Snyder Safety Tech, LLC, Winter Garden, FL (US)

(72) Inventor: Jeffrey Snyder, Winter Garden, FL (US)

( * ) Notice: Subject to any disclaimer, the term of this patent is extended or adjusted under 35 U.S.C. 154(b) by 0 days.

(21) Appl. No.: 15/923,572

(22) Filed: Mar. 16, 2018

(51) Int. Cl.
*G08G 1/07* (2006.01)
*G08B 29/18* (2006.01)

(52) U.S. Cl.
CPC ..... *G08G 1/07* (2013.01); *G08B 29/181* (2013.01)

(58) Field of Classification Search
CPC ..... G08G 1/07
USPC ..... 340/916, 908
See application file for complete search history.

(56) References Cited

U.S. PATENT DOCUMENTS 3,848,562 A * 11/1974 Downing ..... G08G 1/096716 116/284
8,138,948 B1 * 3/2012 Votava ..... G08G 1/07 340/916
9,517,720 B2 * 12/2016 O'Brien ..... B60Q 1/50
2002/0073586 A1 * 6/2002 Backe ..... G09F 7/00 40/612
2016/0017554 A1 1/2016 Snyder

* cited by examiner

*Primary Examiner* — Jack K Wang
(74) *Attorney, Agent, or Firm* — Antonio G Tapia

(57) ABSTRACT

A system for the automatic deployment of traffic control signs during a power outage which enhances public safety, automatically deploys in the event of power outage, can be placed in a plurality of roadway intersections and structures, provides an alternative means to deploy safety and other information, and eliminates driver confusion when deployed. The system essentially comprises a traffic control sign that is bisected and having a top half portion and a bottom half portion connected by a hinge means, an electromagnet attached to the approximate center of the top half portion front surface, an armature plate attached to the bottom half portion front surface, an attaching means attached to the top half portion back surface for affixing the system to a structure in an environment, and at least one power cable extending from the electromagnet and connecting to a powering means in the environment. This system is believed to be useful in a variety of environments and by agencies such as municipal, state and federal departments of transportation.

15 Claims, 10 Drawing Sheets

SYSTEM FOR THE AUTOMATIC DEPLOYMENT OF TRAFFIC CONTROL SIGNS DURING A POWER OUTAGE

TECHNICAL FIELD

This invention relates generally to signs. More specifically this invention relates to traffic control signs. More specifically this invention relates to automated traffic control signs.

BACKGROUND OF THE INVENTION

Traffic can become quite hectic and unsafe when power outages occur due to storms, inclement weather, malfunctions and the like. When for example thunderstorms cause traffic lights to become inoperable, the rates of serious accidents and injuries increase significantly. In the current art and in order to reduce accidents, intersections that become inoperable are maintained by a traffic controller or police officers. However, their response is not always possible and certainly never instantaneous upon the loss of power. Therefore, there is a need for a system that can be implemented concomitantly with existing traffic lights which automatically deploy and display safety information in the event of a power outage.

In the current art, there exist some devices that act as emergency backup systems for traffic light power failures. These devices generally employ secondary powering means such as battery packs. However, these devices run out of power, stop working, require recharging and are relatively expensive.

Therefore, in the applicant's experience, there is a need for a new and useful system for the automatic deployment of traffic control signs during a power outage which possesses the properties of i) enhancing public safety, ii) automatic deployment in the event of power outage, iii) ability to be placed in a plurality of roadway intersections and structures, iv) providing an alternative means to deploy safety and other information, and v) eliminating driver confusion when deployed. The device of the present invention is believed to accomplish all of the foregoing objectives.

SUMMARY OF THE INVENTION

The present invention provides a new and useful system for the automatic deployment of traffic control signs during a power outage which enhances public safety, automatically deploys in the event of power outage, can be placed in a plurality of roadway intersections and structures, provides an alternative means to deploy safety and other information, and eliminates driver confusion when deployed. This system is believed to be useful in a variety of environments and by agencies such as municipal, state and federal departments of transportation.

In one of its basic embodiments, the system comprises a traffic control sign that is horizontally bisected and has a top half portion and a bottom half portion connected by a hinge means, an electromagnet attached to the approximate center of the front surface of the top half portion, an armature plate attached to the front surface of the bottom half portion, an attaching means attached to the top half portion back surface for affixing the system to a structure in an environment, and at least one power cable extending from the electromagnet and connecting to a powering means in the environment.

When the device is in use, device comprises a hinged bisected sign which attached to a structure in the environment, such as a traffic light signal pole. The device is held shut in a closed configuration by an electromagnet. An electromagnet is a type of magnet in which a magnetic field is produced by an electric current. This electromagnet holds both halves of the sign together as long as current is running to the electromagnet. When the system is in a closed configuration no traffic sign information is displayed to the travelers nearby.

In the event of power failure, current ceases to flow to the electromagnet, the magnetic field therefore dissipates and the folded sign deploys by relying on gravity to pull the halves apart. Once deployed to an open configuration, emergency and safety information on the previously obscured surface is now visible to the onlooker.

One envisioned implementation of the present invention is for use at four way intersections which have electric traffic lights. The current invention would exist alongside the existing electric traffic lights, and be powered by a common source. In the event of a power outage whereby the electric traffic lights cease to function, the system would automatically deploy into an open configuration. Each system would display an octagonal stop sign for each direction of traffic and thereby transform the intersection into a four way stop, eliminate driver confusion, and increase safety. Once the power has been restored, the system can be manually or mechanically returned to the closed configuration with an electromagnet or other latch means holding the halves of the sign together.

It is envisioned that the system can be utilized in any area where it is favorable for information to be disseminated upon power failure. It is also envisioned that the information need not only be limited to but at least include traffic, regulatory, warning, marker, guide or informational signs.

Thus the present invention provides a new and useful system for the automatic deployment of traffic control signs during a power outage which has the properties of i) enhancing public safety, ii) automatic deployment in the event of power outage, iii) ability to be placed in a plurality of roadway intersections and structures, iv) providing an alternative means to deploy safety and other information, and v) eliminating driver confusion when deployed. The device of the present invention is believed to accomplish all of the foregoing objectives. Further features and objectives of the present invention will become apparent form the following detailed description and the accompanying drawings.

DETAILED DESCRIPTION OF THE INVENTION

Figure 1:
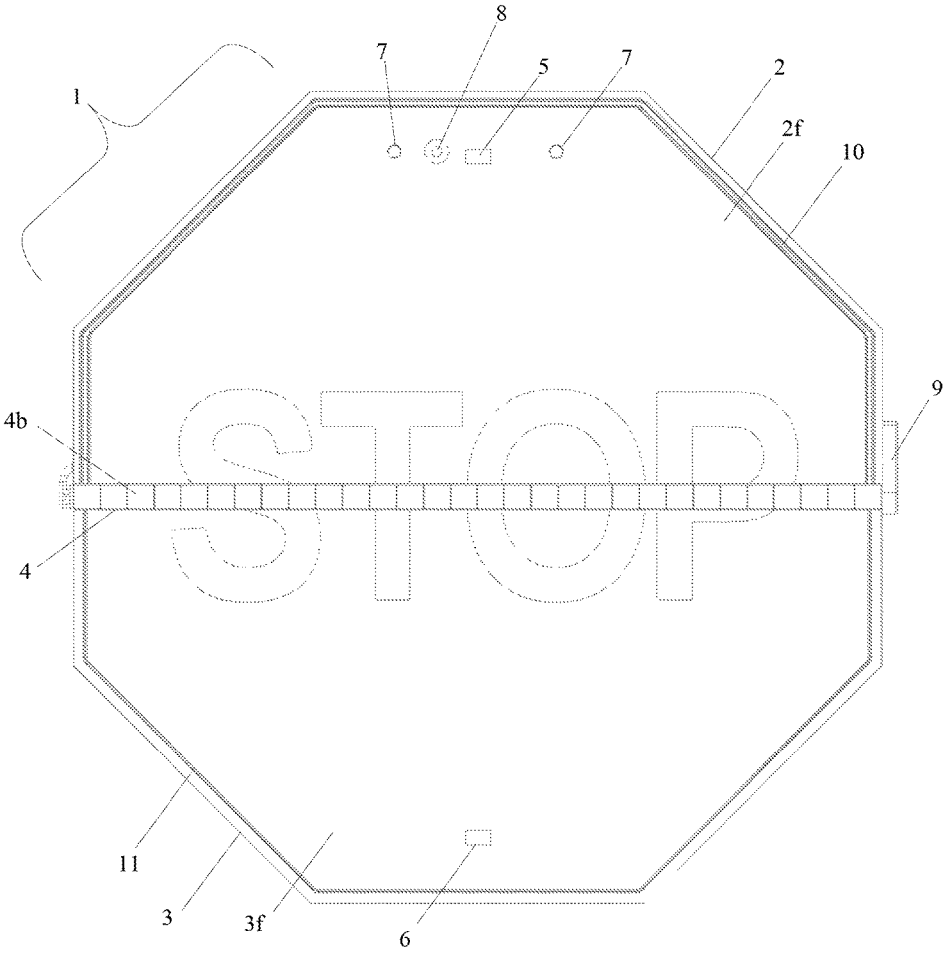
FIG. 1 is a front elevation view of a system for the automatic deployment of traffic control signs during a power outage in a deployed configuration according to the present invention.
Figure 2:
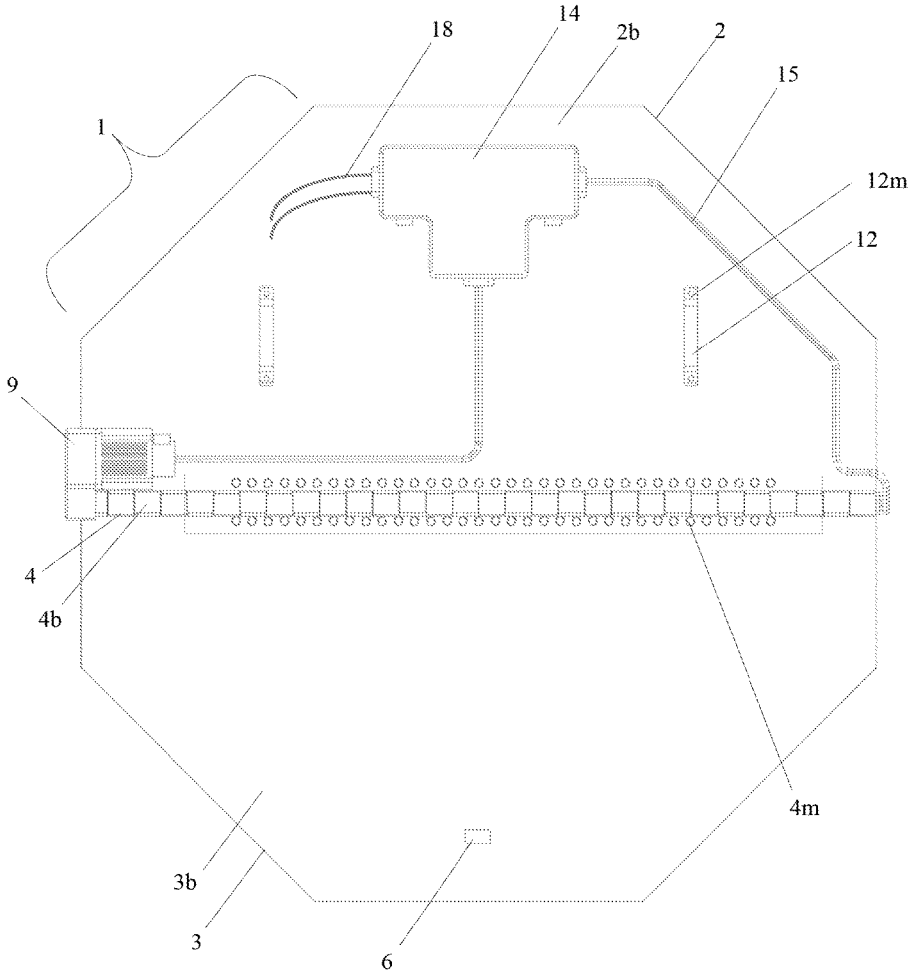
FIG. 2 is a back elevation view of a system for the automatic deployment of traffic control signs during a power outage in a deployed configuration.
Figure 3:
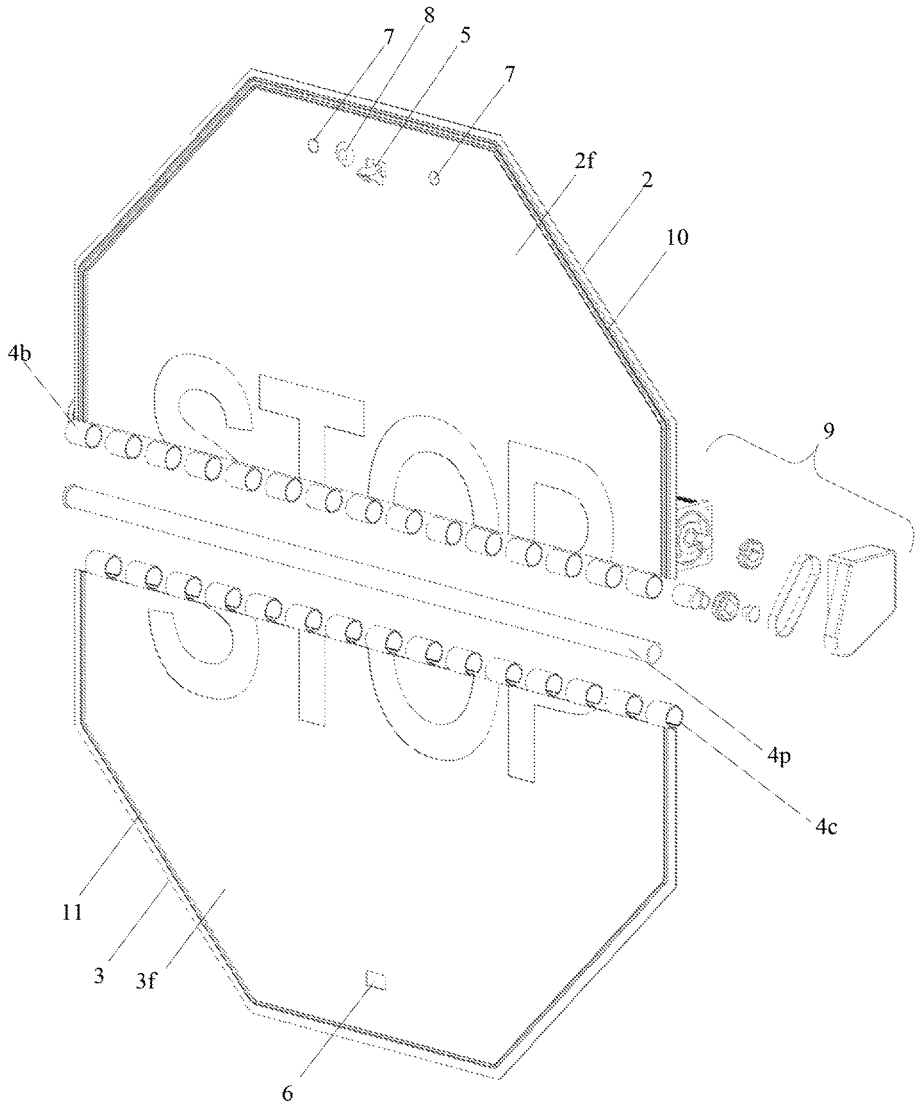
FIG. 3 is an exploded front perspective view of a system for the automatic deployment of traffic control signs during a power outage in a deployed configuration according to the present invention.
Figure 4:
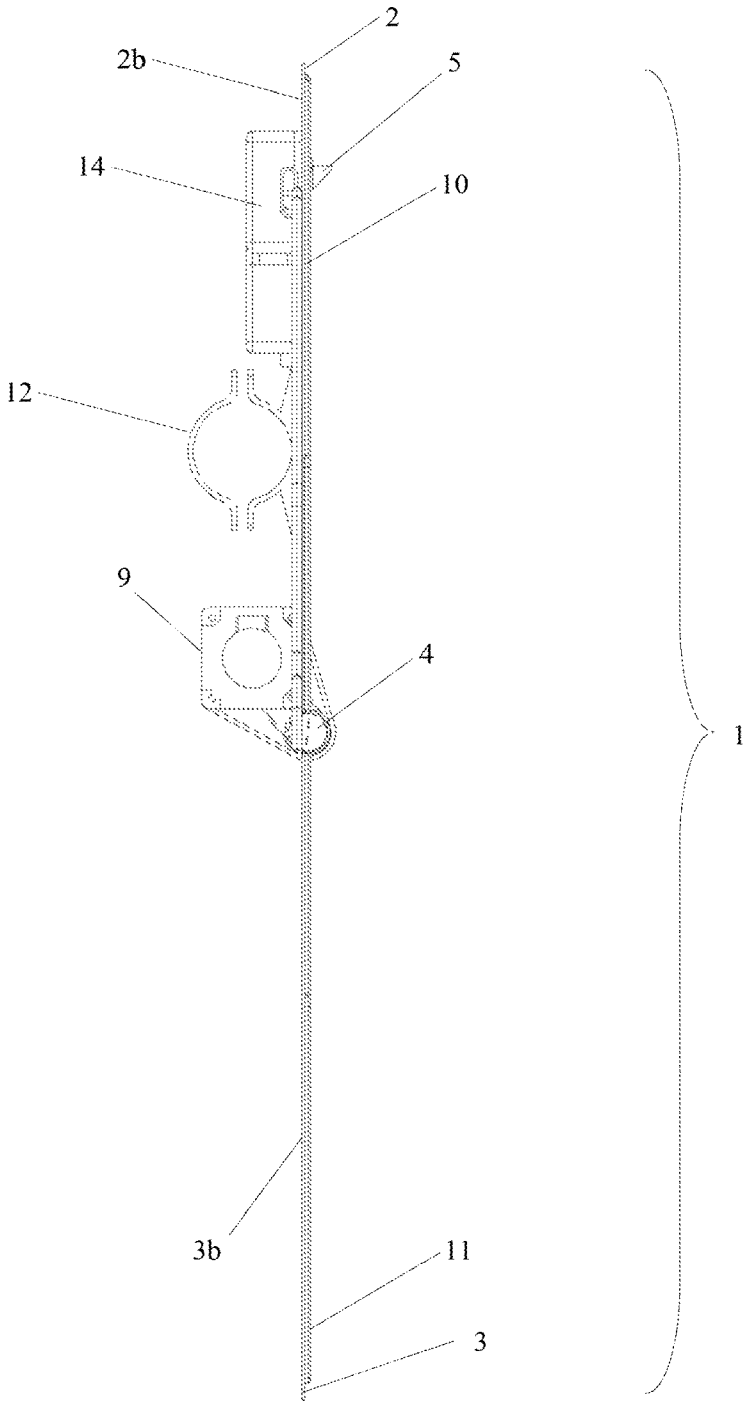
FIG. 4 is a left side elevation view of a system for the automatic deployment of traffic control signs during a power outage in a deployed configuration according to the present invention.
Figure 5:
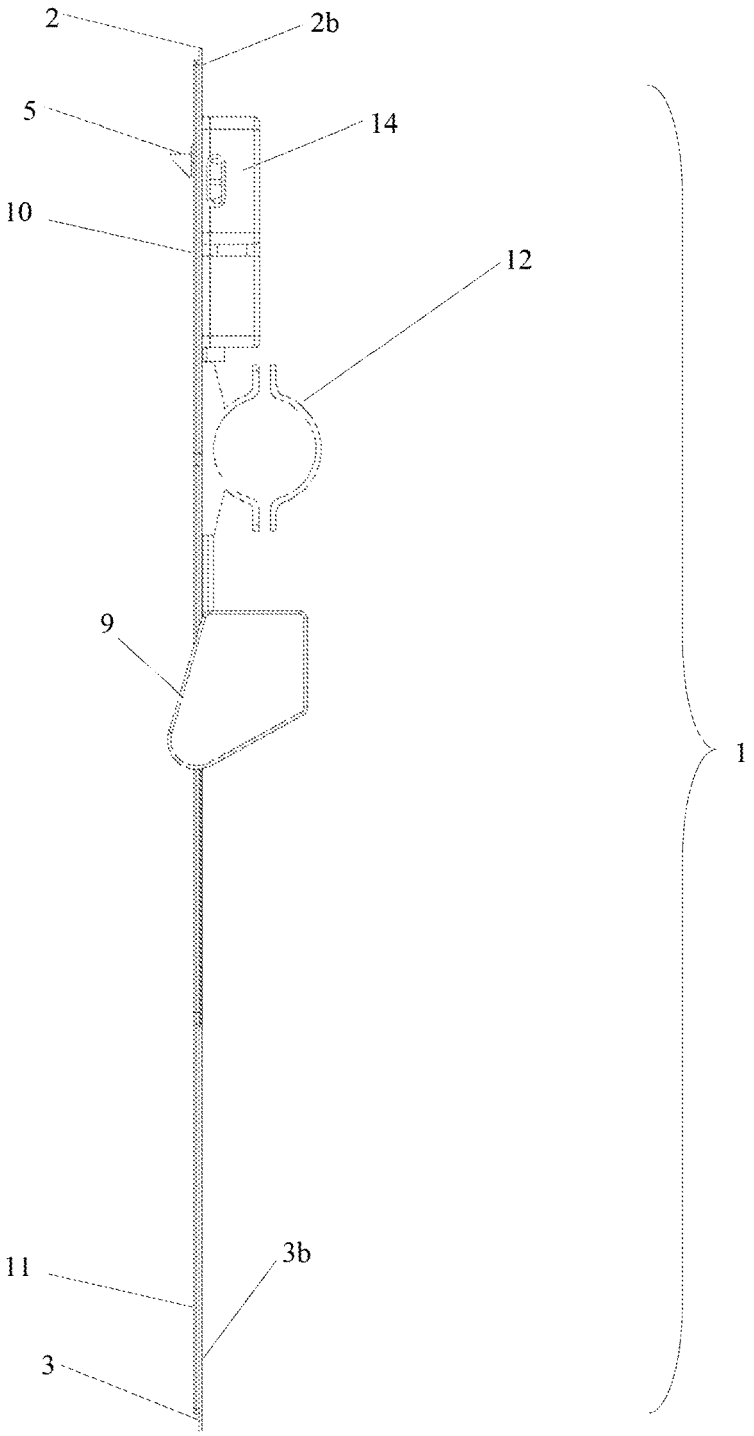
FIG. 5 is a right side elevation view of a system for the automatic deployment of traffic control signs during a power outage in a deployed configuration according to the present invention.
Figure 6:
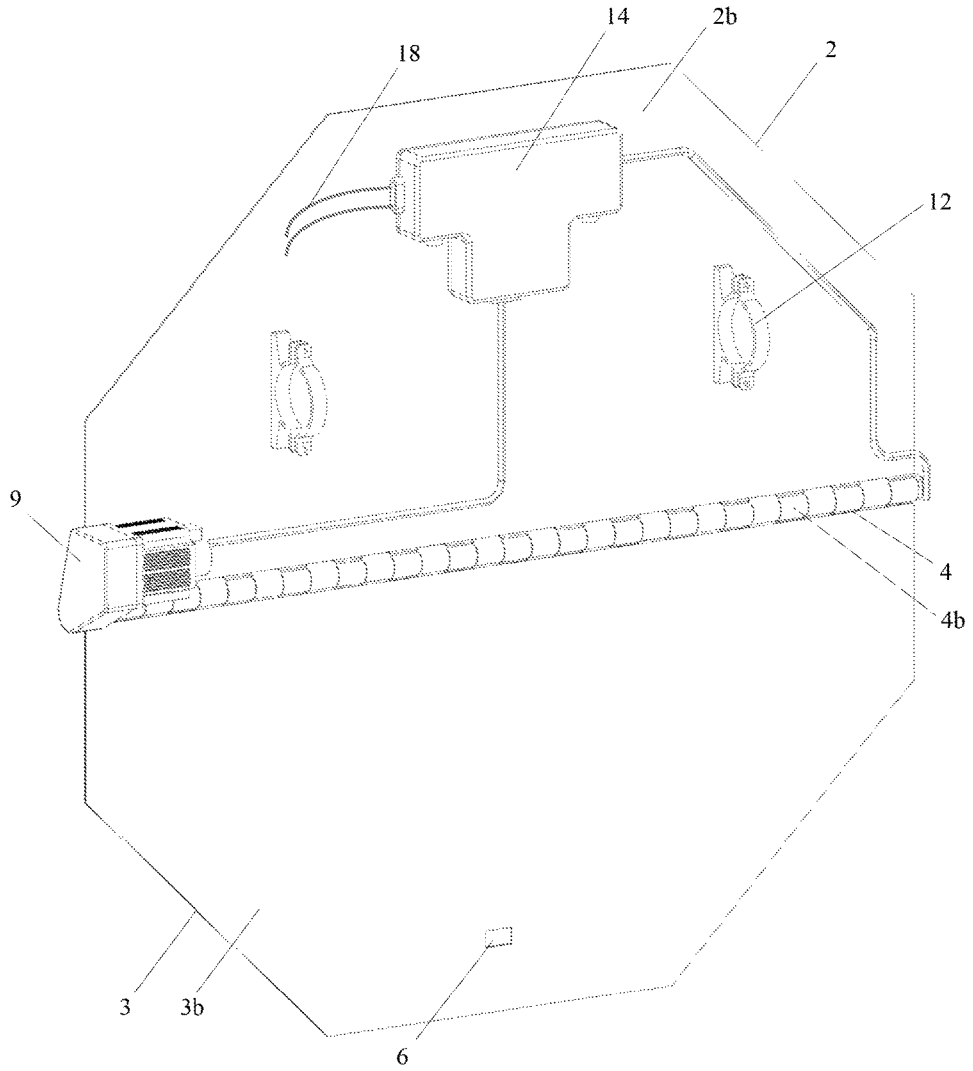
FIG. 6 is a rear perspective view of a system for the automatic deployment of traffic control signs during a power outage in a deployed configuration according to the present invention.

As described above, the present invention provides a new and useful system for the automatic deployment of traffic control signs during a power outage which enhances public safety, automatically deploys in the event of power outage, can be placed in a plurality of roadway intersections and structures, provides an alternative means to deploy safety and other information, and eliminates driver confusion when deployed. This system is believed to be useful in a variety of environments and by agencies such as municipal, state and federal departments of transportation. The following description and accompanying drawings disclose at least one version of the device.

Referring now to FIG. 1 to FIG. 8 and FIG. 10 there is shown a system for the automatic deployment of traffic control signs during a power outage which comprises a traffic sign 1 that is bisected horizontally and has a top half portion 2 and a bottom half portion 3 wherein the top half portion 2 has a top half portion front surface 2*f* and a top half portion back surface 2*b*, and the bottom half portion 3 has a bottom half portion front surface 3*f* and a bottom half portion back surface 3*b*. A hinge 4 having a plurality of segmented barrels 4*b* is connected in a generally horizontal orientation between and to the top half portion 2 and the bottom half portion 3 of the traffic sign 1, which allows the top half portion 2 and bottom half portion 3 to rotationally swing about a central axis of the hinge 4. The hinge 4 has an interior opening angle range of at least 0 to 180 degrees which allows the system to variably present in a closed collapsed configuration with interior opening angle of approximately 0 degrees and a deployed configuration with interior opening angle of approximately 180 degrees. A latch means 5 is attached to the approximate center of a top edge of the top half portion front surface 2*f*, and is aligned and engaged to a latch receiving means 6 on the approximate center of a bottom edge of the of the bottom half portion front surface 3*f* when the system is in a closed configuration. The latch means 5 is at least one electromagnet, or a mechanical latch. The latch receiving means 6 is at least one armature plate, or a mechanical latch eye hole.

In further detail and still referring to FIG. 1 to FIG. 8 and FIG. 10, a plurality of LEDs 7 are attached to the top edge of the top half portion front surface 2*f* for illuminating and signaling when the system is deployed. The LEDs 7 are electronically attached to a rechargeable battery which allows the LEDs 7 to function when the system is deployed. An actuating means 8 is attached to the top edge of the top half portion front surface 2*f* for the forcible deployment of the system. The actuating means 8 is a linear actuator or a solenoid. A deployment means 9 is attached to the back surface top half portion 2*b*. The deployment means 9 is a servomotor which is mechanically connected to the hinge 4 for changing the system between deployed and collapsed configurations and returning the system to a collapsed configuration when power is restored.

The system also has at least one top seal 10 attached near to the top edge of the top half portion front surface 2*f*. The top seal 10 is aligned to receive and engage with at least one bottom seal 11 attached near to the bottom edge of the bottom half portion front surface 3*f* when the system is in a collapsed configuration. The bottom seal 11 has a complimentary topography to the top seal 10 in order to form a barrier from outside elements such as detritus, bird droppings and precipitation in an environment when the system is in a collapsed configuration. At least one system attaching means 12 attached to the top half portion back surface 2*b* for affixing the system to a structure 13 in the environment. The system attaching means 12 is at least one pole clamp, adhesive, straps, bolts, clamps, u bracket, or an adjustable clamp. A weather impermeable electronics housing 14 is attached to the top half portion back surface 2*b* wherein electronic components relating to the latch means 5 and system are housed within an interior void. At least one power cable 18 extends from the electronics housing 14 and connects to a powering means in the environment.

In an alternate embodiment of the present invention, the system further comprises a heating element 15 attached to the hinge 4 in order to heat the system and keep the system from freezing in cold environments and evaporate moisture in damp and wet environments.

In an alternate embodiment of the present invention, the hinge 4 is attached to the top half portion 2 and the bottom half portion 3 by a hinge attaching means 4*m* which is at least one bolt, rivets, weld or adhesive.

In an alternate embodiment of the present invention, the attaching means 12 which is a pole clamp is attached to the top half portion 2 by a pole clamp attaching means 12*m* which is at least one bolt, rivets, a weld or adhesive.

In an alternative embodiment of the present invention, the deployment means 9 is mechanically engaged to top half portion 2 and bottom half portion 3 for changing the system between deployed and collapsed configurations. This alternative deployment means can be a lever or gear.

In an alternative embodiment of the present invention, the latch receiving means 6 is an armature plate that is a permanent magnet.

In an alternate embodiment of the present invention, the hinge 4 further comprises a central pin 4*p* which runs within an interior channel 4*c* formed by the segmented barrels 4*b*.

In an alternative embodiment of the present invention, a plurality of LEDs 7 are attached to the bottom edge of the bottom half portion front surface 3*f* for illuminating and signaling when the system is deployed.

In an alternative embodiment of the present invention, a heating element 15 is attached to the top half portion back surface 2*b*, and heats the system to keep the system from freezing in cold environments and evaporating moisture in damp and wet environments.

Figure 7:
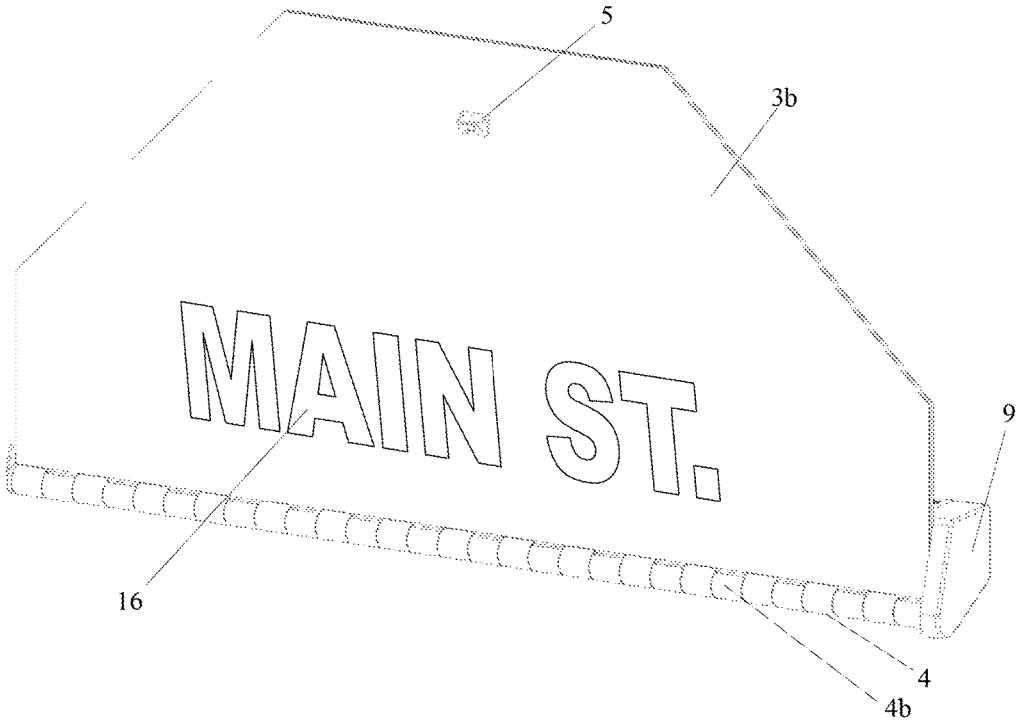
FIG. 7 is a front perspective view of a system for the automatic deployment of traffic control signs during a power outage in a collapsed configuration according to the present invention.
Figure 8:
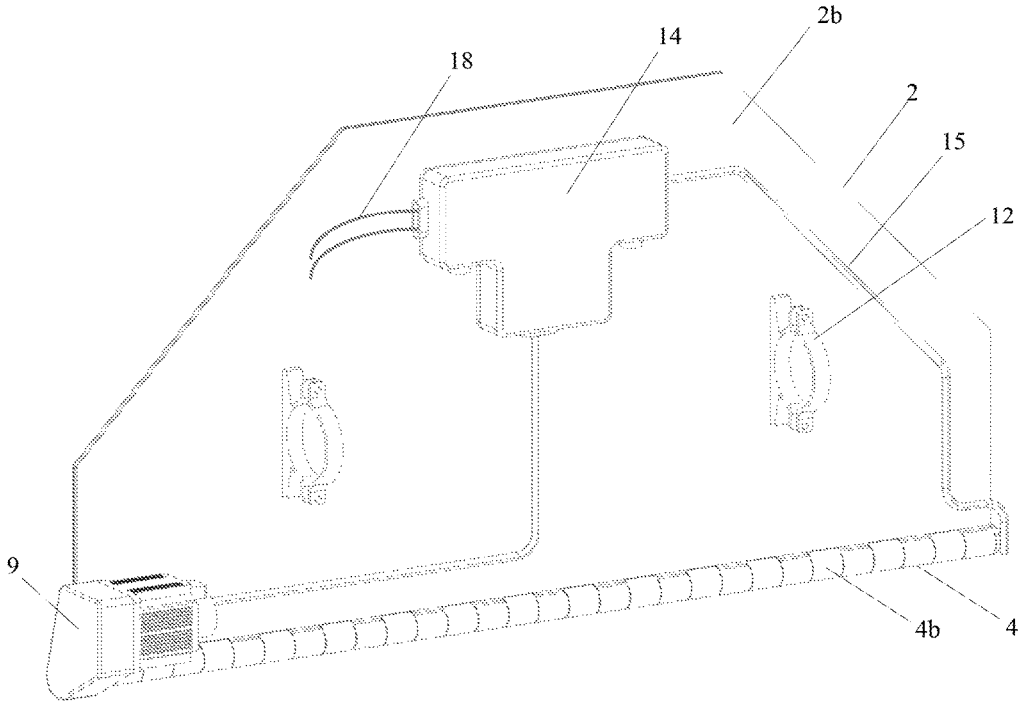
FIG. 8 is a rear perspective view of a system for the automatic deployment of traffic control signs during a power outage in a collapsed configuration according to the present invention.
Figure 9:
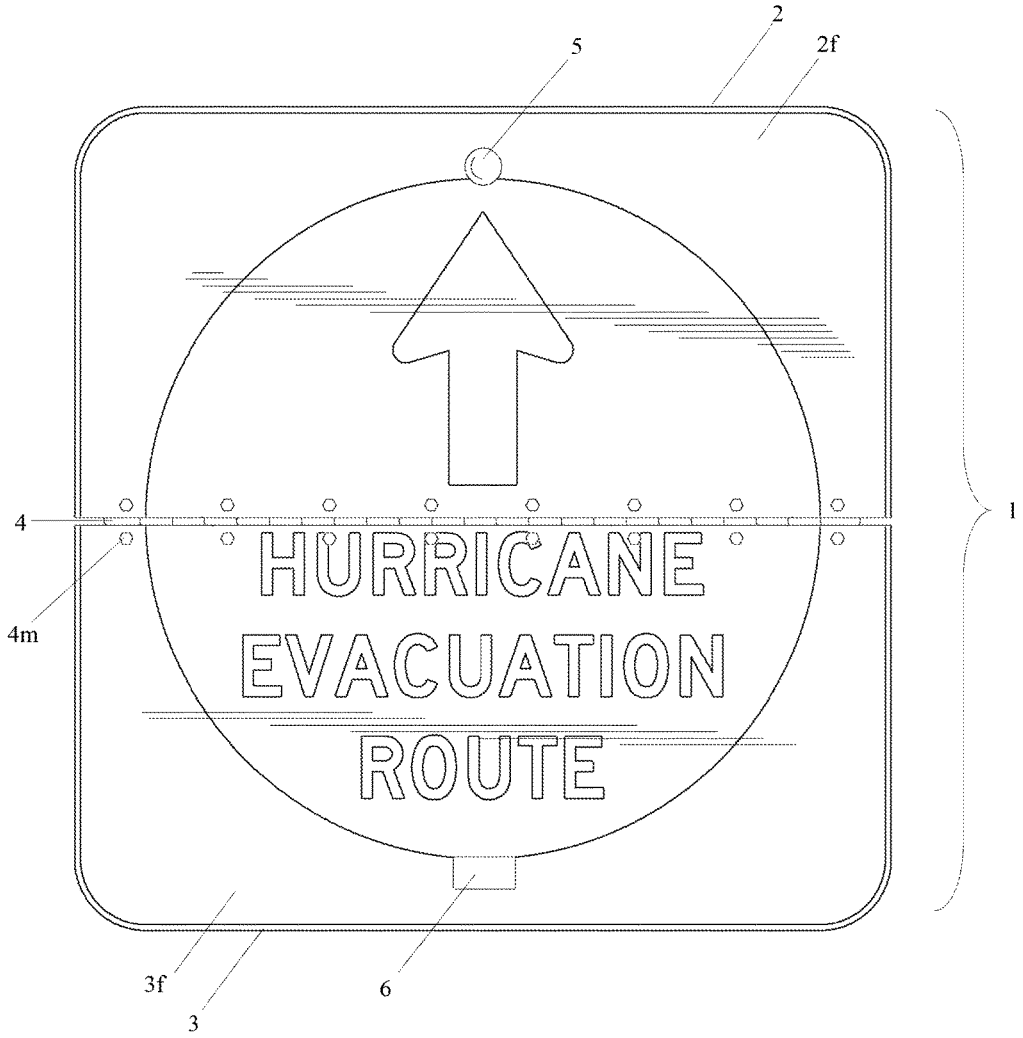
FIG. 9 is a front elevation view of an alternate embodiment of a system for the automatic deployment of traffic control signs during a power outage in a deployed configuration according to the present invention.
Figure 10:
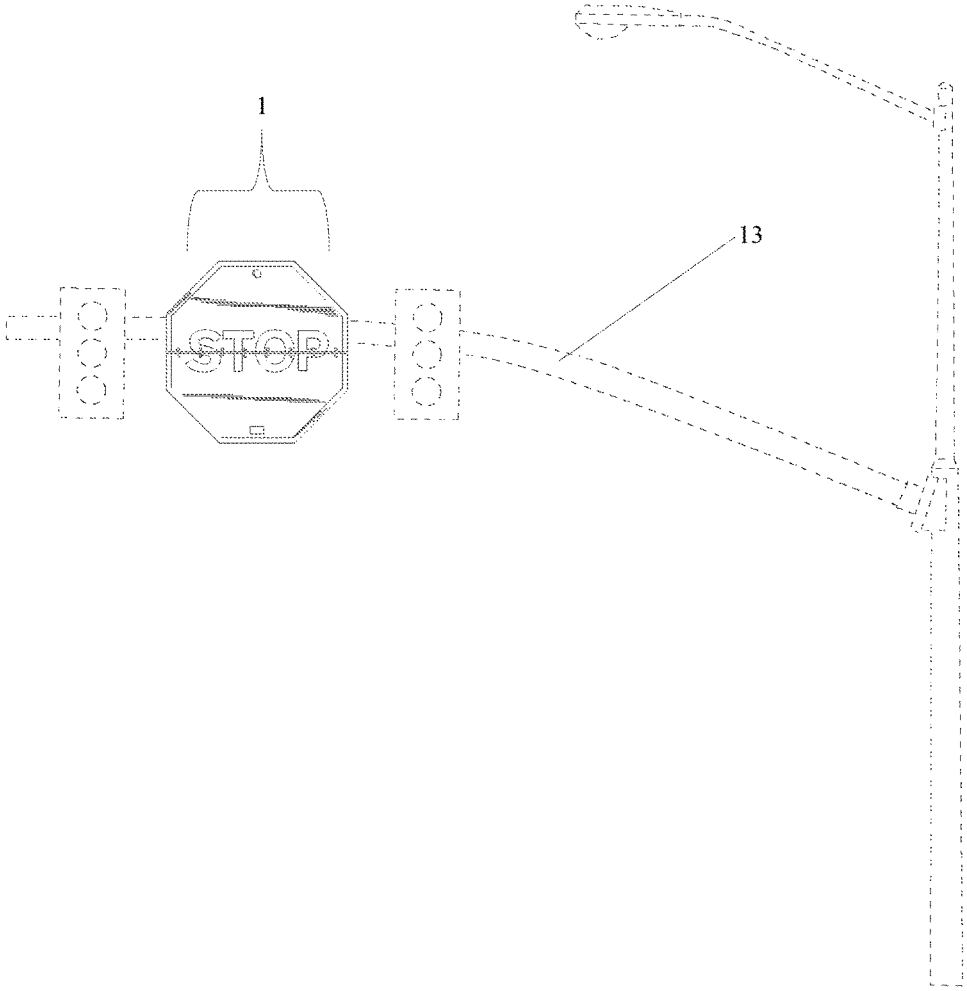
FIG. 10 is a front elevation view of a system for the automatic deployment of traffic control signs during a power outage in a deployed configuration and attached to a traffic light signal pole in the environment.

Now referring to FIG. 7 in an alternative embodiment of the system, an informational design 16 is printed on the bottom half portion back surface 3*b* for the display of information such a street name when the system is in a closed configuration.

In an alternate embodiment of the present invention, a circuit which is a switch that is electronically connected to the latch means 5 which is an electromagnet for the selective reversal of polarity of the electromagnet thereby creating a forcible deployment of the system using magnetic repulsion forces.

In an alternate embodiment of the present invention, a delay circuit is electronically connected to the actuating means 8 to deter deployment during brief power outages. The delay circuit would open the system into the deployed configuration after a pre-determined number of seconds has passed if power is still out. This keeps the system from deploying because of a quick fluctuation in power.

In alternate embodiments of the present invention the attaching means 12 is oriented to attach the system to a horizontal traffic signal pole, a vertical traffic signal pole, or even at variable angles for permanently fixing the system at variable angles to a structure in the surrounding environment. This would be especially advantageous when the system is attached to structures such as arched overpasses or natural features.

The previously described versions of the present invention have many advantages including and without limitation, the properties of i) enhancing public safety, ii) automatic deployment in the event of power outage, iii) ability to be placed in a plurality of roadway intersections and structures, iv) providing an alternative means to deploy safety and other information, and v) eliminating driver confusion when deployed. The device of the present invention is believed to accomplish all of the foregoing objectives. The invention does not require that all the advantageous features and all the advantages need to be incorporated into every embodiment of the invention.

Although the present invention has been described in considerable detail with reference to certain preferred versions thereof, other versions are possible. Therefore the spirit and scope of the appended claims should not be limited to the description of the preferred versions contained therein.

The reader's attention is directed to all papers and documents which are filed concurrently with this specification and which are open to public inspection with this specification, and the contents of all such papers and documents are incorporated herein by reference.

All the features disclosed in this specification may be replaced by alternative features serving the same, equivalent or similar purpose, unless expressly stated otherwise. Thus, unless expressly stated otherwise, each feature disclosed is one example only of a generic series of equivalent or similar features.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. As for "means for" elements, the applicant intends to encompass within the language any structure presently existing or developed in the future that performs the same function. The invention should therefore not be limited by the above described embodiment, method, and examples, but by all embodiments and methods within the scope and spirit of the invention.

What is claimed is:

1. A system for the automatic deployment of traffic control signs during a power outage which comprises:

a) a traffic sign that is bisected horizontally and having a top half portion and a bottom half portion, said top half portion having a top half portion front surface and a top half portion back surface, said bottom half portion having a bottom half portion front surface and a bottom half portion back surface;

b) a hinge having a plurality of segmented barrels connected in between and to the top half portion and the bottom half portion of the traffic sign, thereby allowing the top half portion and bottom half portion to rotationally swing about a central axis of the hinge, said hinge having an interior opening angle range of at least 0 to 180 degrees thereby allowing the system to variably present in a collapsed configuration with interior opening angle of approximately 0 degrees and a deployed configuration with interior opening angle of approximately 180 degrees;

c) a latch means attached to the approximate center of a top edge of the top half portion front surface, said latch means of the top half portion front surface aligned and engaged to a latch receiving means on the approximate center of a bottom edge of the of the bottom half portion front surface, and aligning with and contacting the latch means of the top half portion front surface when the system is in a closed configuration, said latch means is at least one electromagnet, or mechanical latch, said latch receiving means is at least one armature plate, or mechanical latch eye hole;

d) a plurality of LEDs attached to the top edge of the top half portion front surface for illuminating and signaling when the system is deployed, said LEDs electronically attached to a rechargeable battery which allows the LEDs to function when the system is deployed;

e) an actuating means attached to the top edge of the top half portion front surface for the forcible deployment of the system, said actuating means is a linear actuator or solenoid;

f) a deployment means attached to the back surface of the top half portion, said deployment means is a servomotor mechanically engaged to the hinge for changing the system between deployed and collapsed configurations and returning the system to a collapsed configuration when power is restored;

g) at least one top seal attached near to the top edge of the top half portion of the front surface, said top seal aligned to receive when engaged to at least one bottom seal attached near to the bottom edge of the bottom half portion of the front surface when the system is in a collapsed configuration, said bottom seal having a complimentary topography to the top seal in order to form a barrier from outside elements in an environment when the system is in a collapsed configuration;

h) at least one system attaching means attached to the top half portion back surface for affixing the system to a structure in the environment, said system attaching means is at least one pole clamp, adhesive, straps, bolts, clamps, u bracket, or adjustable clamp;

i) a weather impermeable electronics housing attached to the top half portion back surface wherein electronic components relating to the electromagnet and system are housed within an interior void; and j) at least one power cable extending from the electronics housing and connecting to a powering means in the environment and evaporating moisture in damp and wet environments.

2. The system of claim 1 further comprising a heating element attached to the hinge, said heating element heating the system to keep the system from freezing in cold environments.

3. The system as in claim 1 wherein the hinge is attached to the top half portion and the bottom half portion by a hinge attaching means which is at least one bolt, rivets, weld or adhesive.

4. The system as in claim 1 wherein the pole clamp is attached to the top half portion by a pole clamp attaching means which is at least one bolt, rivets, weld or adhesive.

5. The system as in claim 1 wherein the deployment means is a mechanically engaged to top half portion and bottom half portion for changing the system between deployed and collapsed configurations.

6. The system as in claim 1 further comprising an informational design printed on the bottom half portion back surface for the display of information when the system is in a closed configuration.

7. The system as in claim 1 further comprising a circuit which is a switch electronically connected to the electromagnet for the selective reversal of polarity of the electromagnet thereby creating a forcible deployment of the system using magnetic repulsion forces.

8. The system as in claim 1 further comprising a delay circuit electronically connected to the actuating means to deter deployment during brief power outages, said delay circuit would open the system into the deployed configuration after a pre-determined number of seconds has passed if power is still out.

9. The system as in claim 1 wherein the attaching means is oriented to attach the system to a horizontal traffic signal pole.

10. The system as in claim 1 wherein the attaching means is oriented to attach the system to a vertical traffic signal pole.

11. The system as in claim 1 wherein the attaching means is oriented at variable angles for permanently fixing the system at variable angles to a structure in the surrounding environment.

12. The system as in claim 1 wherein the armature plate is a permanent magnet.

13. The system as in claim 1 wherein the hinge further comprises a central pin running within an interior channel formed by the segmented barrels.

14. The system as in claim 1 further comprising a plurality of LEDs attached to the bottom edge of the bottom half portion front surface for illuminating and signaling when the system is deployed.

15. The system as in claim 1 further comprising a heating element attached to the top half portion back surface, said heating element heating the system to keep the system from freezing in cold environments and evaporating moisture in damp and wet environments.

* * * * *